United States Patent [19]

Bodine

[11] Patent Number: 4,629,135

[45] Date of Patent: Dec. 16, 1986

[54] CYCLOIDAL SONIC MILL FOR COMMINUTING MATERIAL SUSPENDED IN LIQUID AND POWDERED MATERIAL

[76] Inventor: Albert G. Bodine, 7877 Woodley Ave., Van Nuys, Calif. 91406

[21] Appl. No.: 228,225

[22] Filed: Jan. 26, 1981

[51] Int. Cl.[4] ..... B02C 19/18

[52] U.S. Cl. ..... 241/201; 241/262; 241/1

[58] Field of Search ..... 241/1, 30, 201, 204, 241/205, 262, 264, 283, 301

[56] References Cited

U.S. PATENT DOCUMENTS

| | | | |
|---|---|---|---|
| 3,131,878 | 5/1964 | Bodine, Jr. | 241/262 |
| 3,414,203 | 12/1968 | Bodine | 241/301 X |
| 3,473,741 | 10/1969 | Bodine | 241/1 X |
| 3,533,567 | 10/1970 | Willems | 241/301 X |
| 4,131,238 | 12/1978 | Tarpley, Jr. | 241/30 |

*Primary Examiner*—Mark Rosenbaum

*Attorney, Agent, or Firm*—Edward A. Sokolski

[57] ABSTRACT

An annular treatment chamber is formed by a gap between inner and outer inertial ("inductively reactive") members. At least one of these members, typically the inner one, is vibratorily driven cycloidally in an orbital path, which is typically circular or elliptical, at a frequency of the order of 50–500 cycles per second. The granular material to be comminuted may constitute material suspended in a liquid or may be in particle form. This material is continually fed into the annular gap and exited therefrom after comminution has been accomplished. While in the annular gap, the material is driven circumferentially around the annular chamber with a high shear force while being subjected to radial vibratory forces developed therein. The fluid material is thus simultaneously subjected to high forces of cyclic nature having both shear and radial components which tends to effect cavitation in liquids and high comminution forces in powdered material to effectively comminute both types of material in the case of liquid material, effectively comminuting the solid particles into a colloidal suspension in the liquid.

15 Claims, 12 Drawing Figures

FIG. 1A
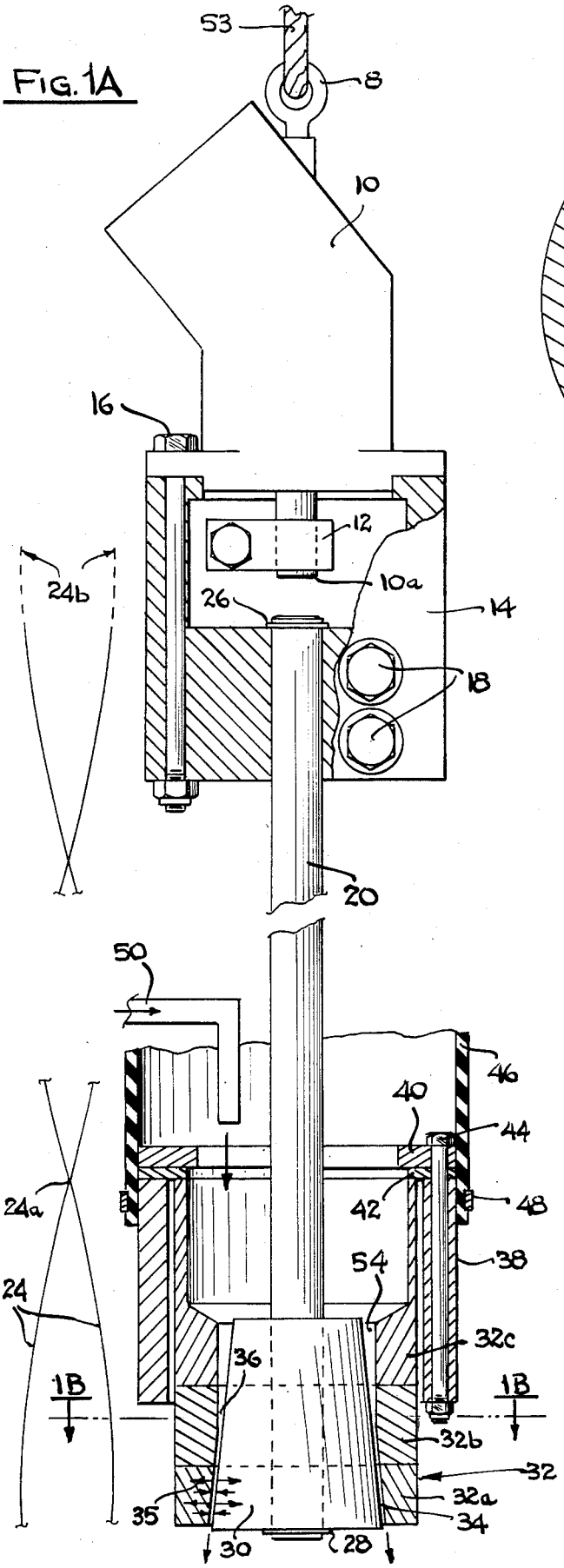
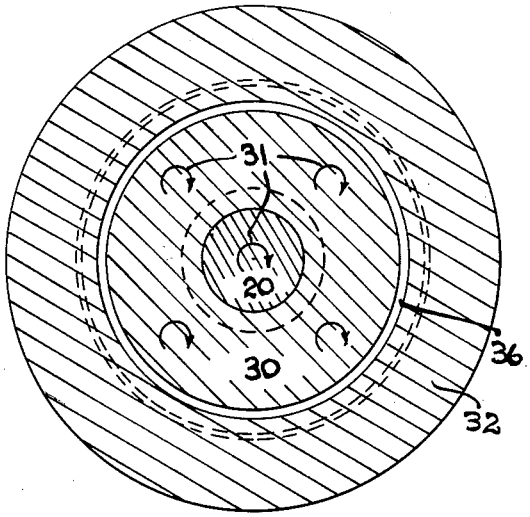
FIG. 1B
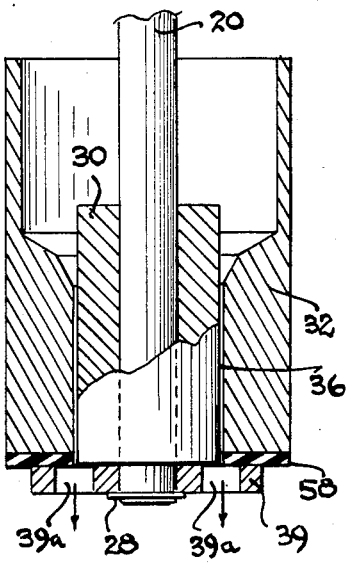
FIG. 2

FIG. 6
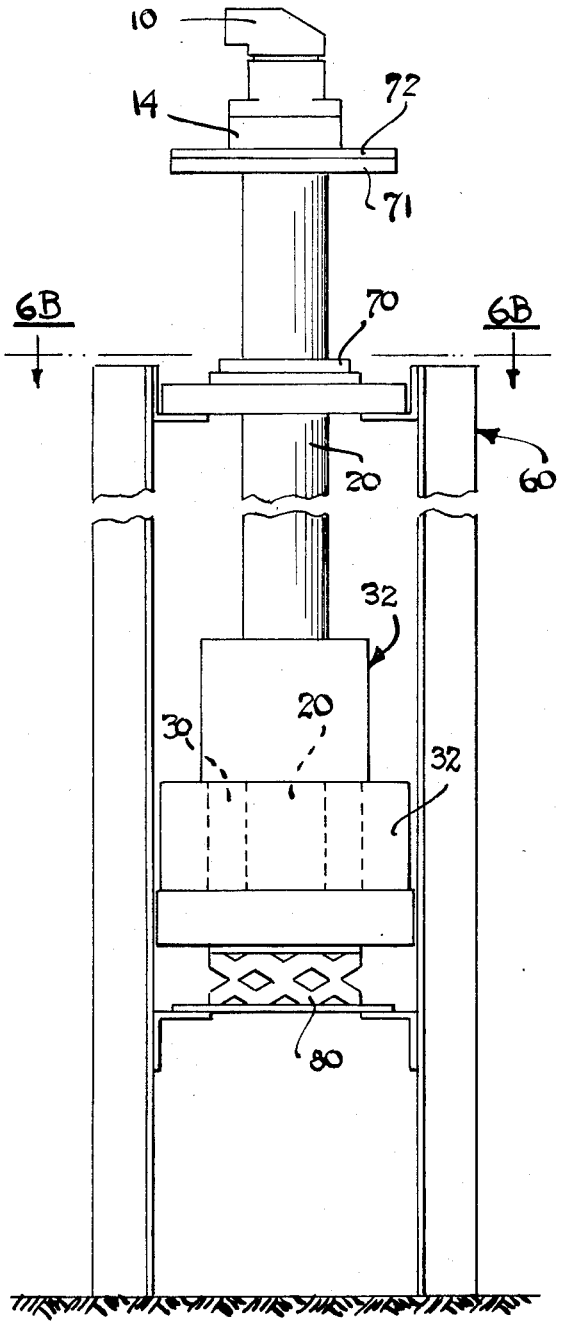
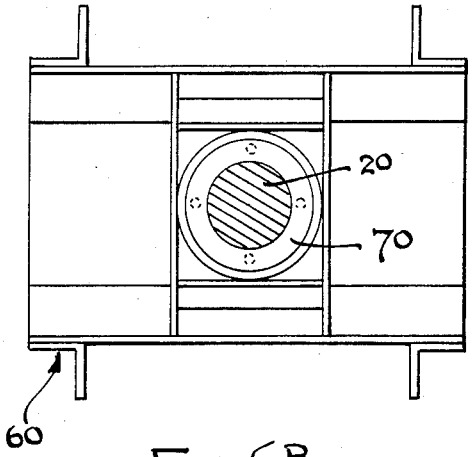
FIG. 6B
FIG. 6A
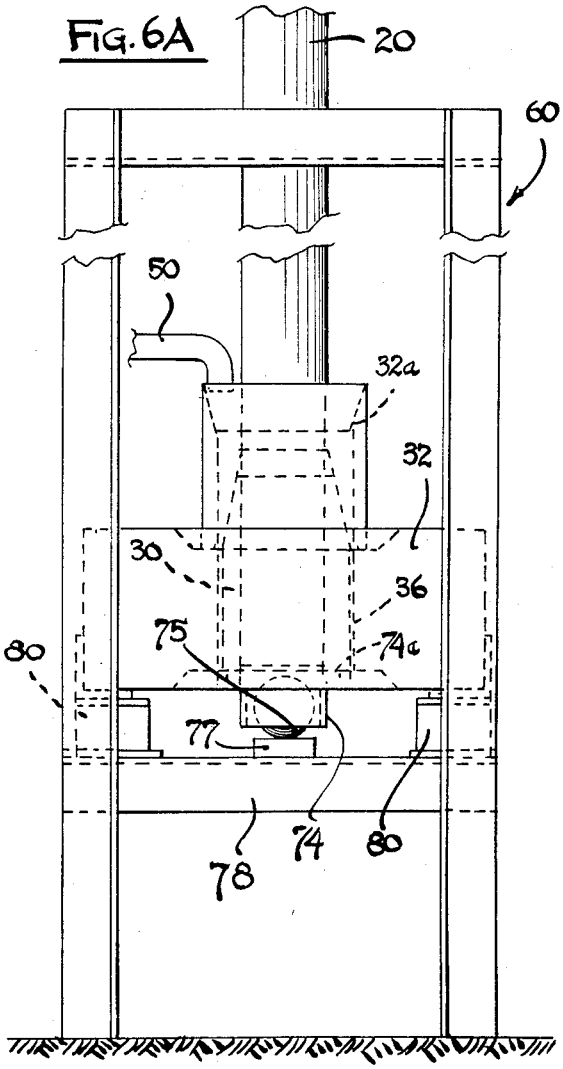

CYCLOIDAL SONIC MILL FOR COMMINUTING MATERIAL SUSPENDED IN LIQUID AND POWDERED MATERIAL

This invention relates to sonic mills for comminuting material suspended in liquid or granular material, and more particularly to such a device and method wherein the comminution is accomplished in an annular gap by means of cycloidal vibratory energy having both shear and radial force components.

Sonic energy has been employed successively in crushing and comminuting material, as described in my U.S. Pat. Nos. 3,284,010; 3,682,397; 3,473,741; 3,414,203; 3,131,878; and 3,429,512. These prior art systems have generally employed inertial members forming jaws between which the material to be crushed or comminuted is fed with one or both of these jaw members being independently vibratorily driven by a resonant vibration system employing a mechanical oscillator. In all of these independent jaw systems, only squeezing vibratory forces are employed which while effective for crushing rock and the like, does not produce the comminution effect needed in certain application requirements, such as the cycloidal comminution of solid material into a colloidal suspension in a liquid or the comminution of dry particle material into relatively fine powder, such as in the comminution of diatomaceous earth. Further, in most of these prior art devices, such as that shown in the U.S. Pat. Nos. 3,429,512 and 3,414,203 patents, the inertial member to which the vibratory system is coupled has a very high mass and thus is limited in amplitude of total motion. Moreover, it is difficult to maintain a fixed gap or to have one centrally driven jaw excite a second inertial jaw with a fixed gap.

The device and technique of the present invention is based on the inventor's discovery that a whirling or rotary-type wave action (two degrees of freedom in quadrature) which is transmitted cycloidally from a resonant vibration system employing an elastic member through a solid inertial member to an annular gap will develop a very high radial force combined with a very high shear cyclic vibrating circumferential force capable of cavitating a liquid material and comminuting a granular material in the gap. At any point along the annular gap, a powerful cyclic radial sonic compression and expansion in the fluid is produced as the gap opens and closes in response to the radial components of the cyclic force. Simultaneously, a large fluctuation in fluid shear stress is developed as the crescent shaped gap pulsates and progresses circumferentially around the gap at high speed, the fluid "squishing" around the annulus vibratorily.

In the case of liquids, the radial vibratory forces cooperate with the shear forces to induce a high level turbulent shear flow to aid in the formation of cavitation bubbles, the cavitation causing viscosity effects which has significant effect on the shear flow.

If it is desired to comminute solid material into a colloidal suspension in a liquid, the two materials can be placed into the annular gap with the implosion of the cavitation causing the liquid to "soak" or penetrate the solid particles and break them apart with the cyclically shear stresses and vibratory impact further comminuting the soaked particles. Such action also occurs where dry particles alone are the work material to efficiently effect comminution thereof.

It is therefore an object of this invention to facilitate the comminution of particulate material.

It is a further object of this invention to provide improved apparatus and technique employing cycloidal sonic vibratory action for comminuting material in an annulus formed between a pair of inertial members.

Other objects of this invention will become apparent as the description proceeds in conjunction with the accompanying drawings of which:

FIG. 1A is a cross-sectional view in elevation of a first embodiment of the invention;

FIG 1B is a cross-sectional view, taken along the plane indicated by 1B—1B, in FIG. 1;

FIG. 2 is a cross-sectional view in elevation of an alternative form of the annular gap chamber which may be employed in the device of the invention;

FIG. 6 is a side elevational view of a further embodiment of the invention;

FIG. 6A is an end elevational view of the embodiment of FIG. 6 shown partly in cross section;

FIG. 6B is a cross-sectional view taken along the plane indicated by 6B—6B in FIG. 6;

Figure 3:
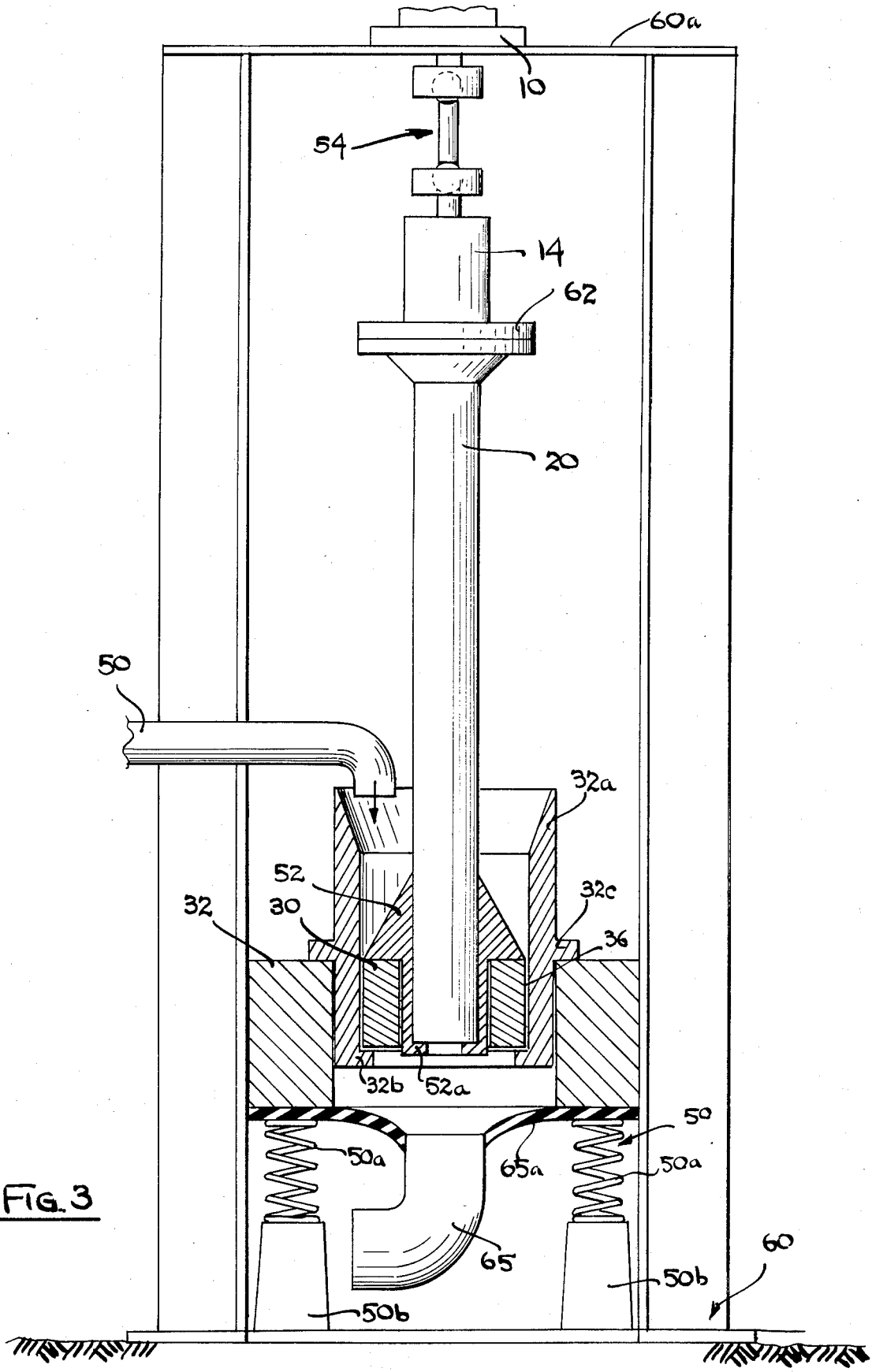
FIG. 3 is an elevational view in cross section of a second embodiment of the invention.

It has been found most helpful in analyzing the operation of the device of this invention to analogyze the acoustically vibrating circuit involved to an equivalent electrical circuit. This sort of approach to analysis is well known to those skilled in the art and is described, for example, in Chapter 2 of "sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance $C_e$, mass M is equated with electrical inductance L, mechanical resistance (friction) $R_m$ is equated with electrical resistance R, and mechanical impedance $Z_m$ is equated with electrical impedance $Z_e$.

Thus, it can be shown that if a member is elastically vibrated by means of an acoustical sinusoidal force, $F_0 \sin \omega t$ ($\omega$ being equal to $2\pi$ times the frequency of vibration), $$Z_m = R_m = j\left(\omega M - \frac{1}{\omega C_m}\right) = \frac{F_0 \sin \omega t}{u} \tag{1}$$

Where $\omega M$ is equal to $1\omega C_m$, a resonant condition exists, and the effective mechanical impedance $Z_m$ is equal to the mechanical resistance $R_m$, the reactive impedance components $\omega M$ and $1/\omega C_m$ cancelling each other out. Under such a resonant condition, velocity of vibration u is at a maximum, power factor is unity, and energy is most efficiently delivered to a load to which the resonant system may be coupled.

It is to be noted that in the device of this invention the mass and compliance for forming the resonantly vibrating system are furnished by the structural members of such system themselves so that the work material and the inertial member are not incorporated as reactances in such system. The work material under such conditions acts as a resistive impedance load which provides no significant reactive components, while the inertial member is coupled to the work material as primarily a high-mass load which remains substantially inert. This employment of apparatus resonance results in a random vibration of the particles of the work material rather than a lumped coherent vibration such as results from non-resonant vibrating apparatus, with a considerable relative motion occurring between the separate particles. It is believed that each of the individual particles when energized by the sonic energy in this sonic resonant fashion separately vibrates in a random path with a relatively fixed radius of vibration which changes in direction but remains fixed in magnitude. Such random vibration effectively separates the particles so that they do not adhere to each other. The net result is a uniquely high degree of fluidization of such particles which effectively aids in the separation of the fully ground material from that requiring additional comminution.

It is also important to note the significance of the attainment of high acoustical Q in the resonant system being driven, to increase the efficiency of the vibration thereof and to provide a maximum amount of energy for the grinding operation. As for an equivalent electrical circuit, the Q of an acoustically vibrating circuit is defined as the sharpness of resonance thereof and is indicative of the ratio of the energy stored in each vibration cycle to the energy used in each such cycle. Q is mathematically equated to the ratio between $\omega M$ and $\omega R_m$. Thus, the effective Q of the vibrating circuit can be maximized to make for highly efficient, high-amplitude vibration by minimizing the effect of friction in the circuit and/or maximizing the effect of mass in such circuit.

Of significance in the implementation of the method and devices of this invention is the high acceleration of the components of the elastic resonant system that can be achieved at sonic frequencies. The acceleration of a vibrating mass is a function of the square of the frequency of the drive signal times the amplitude of vibration. This can be shown as follows:

The instantaneous displacement y of a sinusoidally vibrating mass can be represented by the following equation:

$$y = Y \cos \omega t \tag{2}$$

where Y is the maximum displacement in the vibration cycle and $\omega$ is equal to $2\pi f$, f being the frequency of vibration.

The acceleration a of the mass can be obtained by differentiating Equation 2 twice, as follows:

$$a = \frac{d^2y}{dt^2} = -Y\omega^2\cos(\omega t) \tag{3}$$

At resonance, Y is at a maximum and thus even at moderately high sonic frequencies, very high accelerations are achieved making for correspondingly high cycloidal vibrational forces on the work material.

In considering the significance of the parameters described in connection with Equation 1, it should be kept in mind that the total effective resistance, mass, and compliance in the acoustically vibrating circuit are represented in the equation and that these parameters may be distributed throughout the system rather than being lumped in any one component or portion thereof.

Referring to FIGS 1A and 1B, a first embodiment of the invention is illustrated. Eccentric rotor 12 is mounted on drive shaft 10*a* of hydraulic motor 10 within housing 14, the rotor and housing forming an orbiting mass oscillator. Hydraulic motor 10 is clamped to housing 14 by means of bolts 16. The housing is preferably made from a material such as aluminum to make for a low mass, thus keeping its acoustic "inductance" effect down. Housing 14 is clamped to elongated elastic bar member 20 by means of squeeze bolts 18, the bar being made of a highly elastic material, such as steel. A snap ring 26 is installed over the top end of elastic bar 20 to aid in supporting the load of the bar and the members attached thereto on housing 14.

Inner inertial mass member 30, which forms an "inductive" reactance in the vibratory system, fits over the bottom portion of elastic bar member 20 and is prevented from falling therefrom by snap ring 28. Outer inertial mass member 32, which also forms an "inductive" reactance in the vibration system, is supported loosely on inner mass member 30 by virtue of the engagement of the opposing inner conical surface of member 32 and outer conical surface of member 30. Outer mass member 32 may be divided into three separate cylindrical sections 32*a*, 32*b* and 32*c*, this to ameliorate the tendency of the outer mass member to bounce excessively on occasion. Ring sleeve 38 is mounted on the top edge of member 32 by means of shoulder ring 40 and damper ring 42 which is placed thereunder, these rings being retained on the sleeve by means of bolts 44. Splash guard sleeve 46 of a resilient material such as rubber is retained to the ring sleeve by means of clamp band 48. A work material, such as powder to be comminuted or a powder-liquid mixture in which the powder is to be formed into a colloidal suspension, are fed into the receptacle formed by the inner walls of the top portion 32*c* of mass member 32 through conduit 51. This material runs into annular gap 36 formed between inner and outer mass members 30 and 32 respectively, and is finally discharged from the lower edge of the gap. The entire assembly is suspended by means of a cable 53 which is fitted through eye member 8 attached to the outer wall of motor 10.

Typically, the work material 53 may be a diatomaceous earthen material to be comminuted or coal particles which are mixed with a liquid to be colloidally suspended therein for use as heating oil.

The device of the invention operates as follows: High speed hydraulic motor 10 rotatably drives oscillator rotor 12 to generate vibratory energy which is delivered through the bearings of the motor shaft 10*a* to oscillator housing 14. This energy in turn is delivered from the housing to elastic cylindrical bar member 20. The speed of rotation of rotor 12 is adjusted to a frequency whereat resonant vibration of bar member 20 occurs in a lateral rotary wave vibrational mode which can be resolved into a pair of quadrature lateral force vectors. The standing wave vibrational pattern of bar member 20 is indicated in a single plane by graph lines 24 with the nodal points of the vibratory pattern being indicated at 24*a* and the antinodal points being indicated at 24*b*.

This whirling wave transmission down bar 20 causes the lower end thereof to bend around with cycloidal circular motion 31, as indicated in FIG 1B, so that mass member 30 vibrates in a pattern whereby every part thereof describes a closed orbit, such as a circle or ellipse. As to be noted from the graph pattern 24, large cyclic force is maintained in the gap area 34 by virtue of the resonant vibration pattern. The gap 36 between the inner and outer mass members takes the form of a crescent which geometric crescent effectively rotates cycloidally in its orientation at the vibration frequency. Thus, in any one instance, the gap is at a minimum on one side and a maximum at the other side. This results in a circumferential shear velocity of the work material 54 around the gap. At the same time superimposed on this cycloidal annular pumping action of the work material there is a radial vibratory action as indicated by arrows 35 due to the expansion and contraction of the gap at each and every point therearound.

It is important to note that the mass inertial member 32 effectively acts as a seismic reactance in space. Its motion or stroke is variable and the reactance force created against inner mass member 30 and the latter's attempt to accelerate the mass reactance of member 32 always in opposed direction are all subject to values of 32 alone as a dynamic reactance inertial seismic mass in space. There are no equal and opposite reaction stresses taking place through any interconnecting structure. Mass member 32 effectively "floats in space" and generates the desired milling forces by its dynamic interaction through mass member 30 and bar member 20 with the orbiting "inductive" mass of rotor 12. Member 30 "throws" the mass 32 first in one direction and then meets it in opposition on the other side of the gap. The crushing stresses are thus limited solely by the inertial reactance of mass members 30 and 32 and no large enveloping machine structure is subjected to high stress as in conventional crushers. Controlled cyclic force rather than controlled fixed cyclic stroke is employed, and this is accomplished with high frequency vibration.

Referring now to FIG. 2, an alternative configuration for the mass members 32 and 30 of the invention is illustrated. In this embodiment, the inner walls of mass members 30 and 32 are cylindrical rather than conical. Further, a perforated support plate 39 is provided to support outer mass member 32 on shaft 20 in conjunction with snap ring 28. A rubber cushioning ring 58 is provided between mass member 32 and support plate 39. The gap 36 is thus fixed and does not vary as in the previous embodiment wherein the outer mass member rises automatically due to the vibration to create the gap between the inner and outer mass members. This particular configuration has advantages with certain types of work material having liquid present wherein pressure confinement is an advantage. In this configuration, the work material, after having passed through gap 36, is exited through perforations 39*a* formed in the support plate.

Referring now to FIG. 3, a second embodiment of the invention is illustrated.

In describing the embodiment, the same numerals are used to designate corresponding elements of the embodiments of FIGS. 1A–1B. This embodiment, rather than employing suspension means with the device, utilizes a stand with the units being assembled in a compressive type arrangement. Outer mass member 32 is cylindrical in configuration and is carried on spring suspension assembly 50 which comprises a plurality of coil springs 50*a* which are supported on pillars 50*b* which in turn are supported on the base of stand 60. Outer mass (inductive reactance) member 32 has a replaceable cylindrical liner sleeve 32*a* which has an annular shoulder 32*c* which rests on the top surface of the main body portion of the inertial mass member 32. Inner mass member 30 may be formed by a hardened steel roller which rests on shoulder portion 32*b* of the sleeve. Insert member 52 rests on the top surface of mass member 30 and supports elastic bar member 20 on this mass member. Elastic bar 20 is fitted closely in insert 52 with its walls in engagement against the walls of the insert and with the bottom thereof abutting against annular shoulder 52*a* of the insert, the insert having a cylindrical configuration for its inner wall. The externally conical shape of the upper portion of insert 52 is particularly effective for crushing any large chunks in the input load.

The sonic oscillator is of the same basic configuration as that of the first embodiment and has a housing 14 which is tightly clamped to the top end of elastic bar 20 by means of clamp fitting 62. As for the first embodiment, the oscillator has an eccentric rotor (not shown) mounted within the housing 14 which is rotatably driven by motor 10. In this second embodiment, the motor 10 is mounted on the top structure 60*a* of support stand 60 and is coupled to the oscillator rotor by means of a conventional universal joint and drive shaft assembly 54. The work material is fed into the receptacle formed by liner sleeve 32*a* by means of pipe 51 and outletted from the bottom end of the mill through outlet funnel 65, after having been comminuted or placed in colloidal suspension (as the case may be) by virtue of the action thereon in gap 36. Outlet funnel 65 is supported by means of rubber flange 65*a* which is attached to the outer wall of the funnel and supported between springs 50*a* and the bottom surface of inertial mass member 32.

This second embodiment operates in the same general manner as the first embodiment in comminuting powdered material or placing material in colloidal suspension in a liquid by virtue of the cycloidal sonic energy developed in the gap 36 between inner inertial mass member 30 and outer inertial mass member 32. The conical shape of insert 52 is effective in a preliminary way to break up any large chunks so that all material can flow into gap 36.

Figure 4:
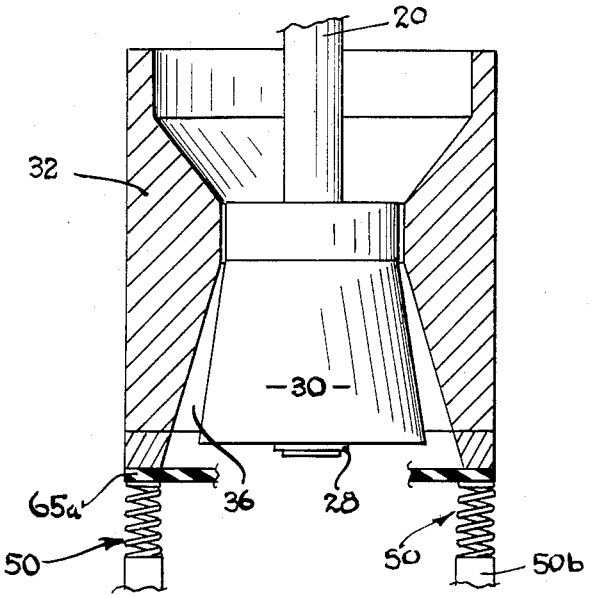
FIG. 4 is an elevational view in cross section of an alternative form for the annular chamber employed in implementing the invention.

Referring now to FIG. 4, a variation in the structural configuration of the inner and outer mass members of the embodiment of FIGS. 2 or 3 is shown. In this embodiment, the gap 36 is conically shaped with the gap width increasing in the downward direction to provide a clearance shape around member 30 that somewhat corresponds to the shape of the conical vibrational wave pattern 24 below its nodal region 24*a* (see FIG. 1A). The lower portion of the driven inertial mass member 30 thus is free to describe a greater cycloidal amplitude than does the upper region thereof, to enhance the freedom of the wave pattern. Moreover, the progressively enhanced vibration amplitude in a downward direction of the gap results in a downward pumping effect which increases the through-put of the device. In this embodiment, as in the embodiment of FIG. 1A, the bottom end of elastic bar member 20 is retained to inner mass member 30 by means of snap ring 28. As with the embodiment of FIG. 3, the outer inertial mass member 32 is supported on a spring suspension 50.

Figure 5:
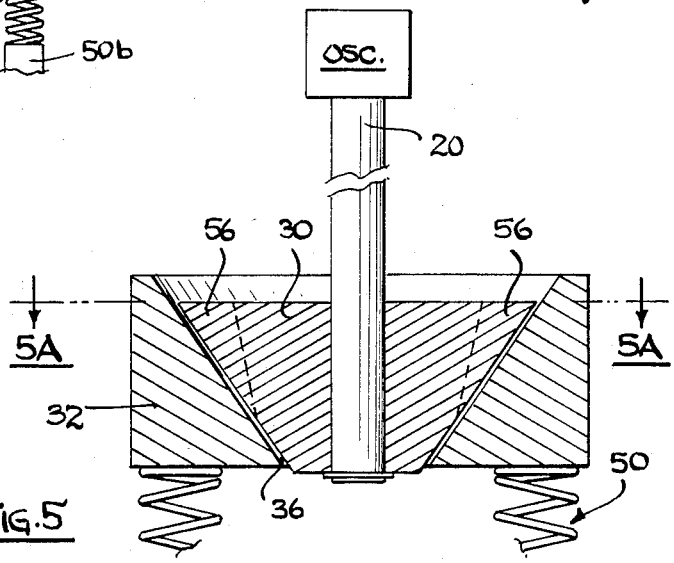
FIG. 5 is an elevational view in cross section of a modified form of the annular chamber employed in the embodiment of FIG. 3.
Figure 5A:
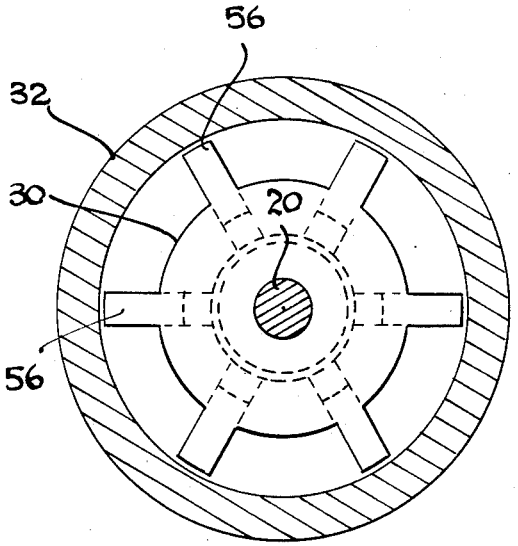
FIG. 5A is a cross-sectional view taken along the plane indicated by 5A—5A in FIG. 5.

Referring now to FIGS. 5 and 5A, a further variation for the milling portion of the device of FIG. 3 is shown. In this variation, outer inertial mass member 32 has an inner wall which forms a cone which runs inwardly in a downward direction at a relatively wide angle to form a gap 36 between it and the opposing walls of inner inertial member 30. Elastic bar member 20 fits tightly within a mating cavity formed in the center of inertial mass member 30. Ribs 56 are formed around member 30 to define fluted passages therebetween which aid in increasing the rate of throughput. The use of such a wide angle conical gap between the inertial mass members tends to provide stability to the system in situations where the work material tends to cause a gripping effect between the members with resultant vertical climbing of one of such members.

Referring now to FIGS. 6, 6A and 6B, a further embodiment of the invention employing a stand for supporting the milling device in compression is illustrated. In this embodiment, as for the embodiment of FIG. 3, the operating mechanism is supported on a stand 60. Elastic bar member 20 is welded to flange 71 at its top end. Oscillator housing 14 is similarly welded to flange 72 which is bolted to flange 71. Oscillator motor 10, which may be an hydraulic motor such as for the first described embodiment, rotatably drives the eccentric oscillator rotor (not shown) mounted within oscillator housing 14 to develop cycloidal vibratory energy which is transferred to elastic bar member 20 as for the previous embodiments. Elastic bar member 20 is loosely fitted through guide bushing 70 which is fixedly supported on stand 60. The bottom end of elastic bar member 20 rests on a support cup member 74 which in turn is supported on support ball member 75, the ball member resting on support plate 77, which is fixedly attached to support arm 78 of the frame. Ball member 75 is only loosely confined within cup member 74 to ensure that the annular gap 36 can freely respond dimensionally to the vibratory energy. Inner inertial mass member 30 is generally cylindrical in shape and is supported on shoulder **74*a* of the cup member. The non-driven outer inertial mass member 32, which is rectangular in shape, is supported on an elastic rubber mount 80. As for the embodiment of FIG. 3, outer inertial mass member 32 has a liner sleeve 32*a* which serves as a receptacle for receiving the work material fed thereto from inlet pipe 51. As for the previous embodiments, this work material is fed to gap 36 formed between inner inertial mass member 30 and outer inertial mass member 32** where it is cycloidally comminuted or placed in a colloidal suspension in a liquid, as the case may be.

Figure 7A:
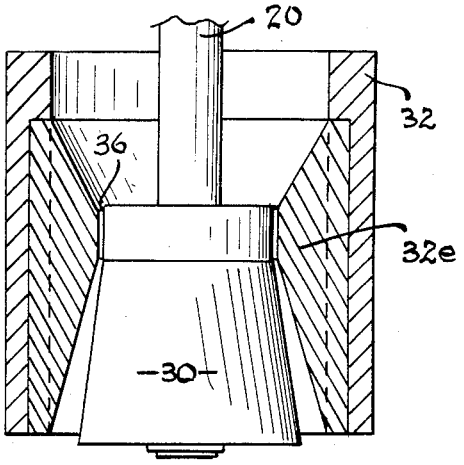
FIG. 7A is a cross-sectional view taken along the plane indi cated by 7A—7A in FIG. 7.
Figure 7:
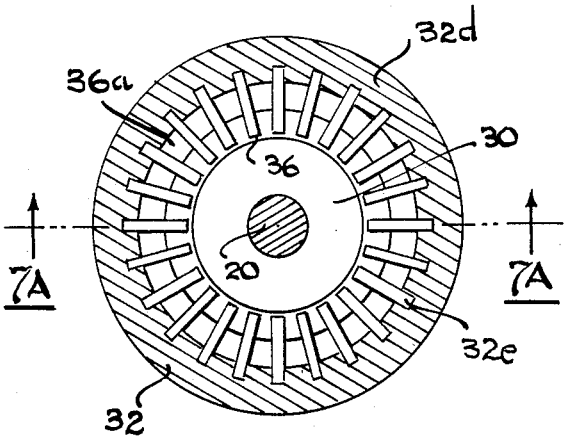
FIG. 7 is a top plan view of an alternative form of the outer inertial mass member which may be employed.

Referring now to FIGS. 7 and 7A, an alternative form for the outer inertial mass member is shown. Inertial mass member 32, which may be used for example with the system shown in FIG. 4, has outer holding sleeve **32*d* tightly holding a set of radially oriented inner ribs 32*e*. Open gaps 36*a* provide radially expanding passages between ribs 32*e*** for the quick release and dropping of sized material thus forming the output.

In operation, the work material moves downward and is comminuted or crushed at the inner edges of ribs **32*e* in gap 36 as above described until the material reaches a predetermined particle size whereupon the so sized particles escape easily radially and downwardly through geometrically expanding passages 36*a* rather than becoming overly crushed by further downward progression in gap 36 along the inner edges of ribs 32*e***. There are many uses for sized particles, such as coal feed for the well known retorting processes (where "fines" cause trouble) and limestone in animal feed.

In considering certain characteristics of this invention it is important to note, for example, that inertial member 32 is alternately forced from one side so to speak to the other by member 30 acting against member 32. The gap is thus never thrown widely open by excursions in space of member 32, because the excursions of member 32 are always met by subsequently opposed excursions of member 30 going momentarily (180° in time later) in the opposite direction on the other side of the gap 36 during the cycle. Thus, member 30 throws member 32 back and forth, developing large contact forces of cyclic acceleration, and assuring that the gap 36 stays small for fine comminution. The actual vibratory excursions of member 32 are therefor in part a function of the crushing force in the material in gap 36. Whereas conventional crushers usually have a fixed stroke and therefore uncontrolled variable force in the work material, the device of this invention subjects the material to a controlled cyclic force which is a function of the sonic acceleration and mass of member 32; and the actual stroke of member 32 is variable, depending in part upon the hardness of the work material which is transmitting the sonic acceleration forces from member 30 to member 32.

While the invention has been described and illustrated in detail, it is to be clearly understood that this is intended by way of illustration and example only and is not to be taken by way of limitation, the spirit and scope of the invention being limited only by the terms of the following claims.

I claim:

1. A sonic milling device comprising an elastic member, oscillator means for generating vibratory energy having a cycloidal force pattern which can be resolved into a pair of quadrature relative, lateral force vectors, means for coupling said cyloidal force pattern energy in an orientation such as to cause rotary elastic vibration of said elastic member, a first inertial mass member connected to said elastic member to receive the rotary cycloidal energy therefrom, said first inertial mass member having a predetermined working surface defining a figure of revolution, a second inertial mass member having a predetermined working surface encircling and directly opposite the working surface of the first mass member, an annular gap having inlet and outlet portions being formed between said working surfaces, and means for delivering work material to the inlet portion of said gap, said work material being simultaneously subjected to cyclic radial forces and shear forces in the annular gap between said working surfaces, said work material being exited from the outlet portion of said gap after having passed therethrough.

2. The milling device of claim 1 wherein the vibratory energy generated by said oscillator is at a frequency such as to cause resonant elastic vibration of said elastic member.

3. The milling device of claim 1 wherein said elastic member comprises an elongated elastic bar member.

4. The milling device of claim 1 wherein at least one of said working surfaces is conical.

5. The milling device of claim 1 wherein both of said working surfaces are cylindrical.

6. The milling device of claim 1 wherein both of said working surfaces are conical.

7. The milling device of claim 1 wherein the gap increases in width between the inlet and outlet portions thereof.

8. The milling device of claim 1 wherein the second inertial mass member is externally concentric with said first inertial mass member.

9. The milling device of claim 8 wherein the working surface of the second member is conical and slopes inwardly at a relatively wide angle towards the outlet portion of said gap.

10. The milling device of claim 9 and further including a plurality of ribs extending outwardly from said first inertial mass member, fluted passages being formed between the ribs to facilitate the flow of said work material to said gap.

11. The milling device of claim 1 and further including means for suspensively supporting said device with said elastic member being suspended from said oscillator means and said mass members being suspended from said elastic member.

12. The milling device of claim 11 wherein said second inertial mass member is externally concentric with said first inertial mass member, the working surfaces of said mass members both being conical, the second mass member being supported loosely on said first mass member by virtue of the engagement of said working surfaces.

13. The milling device of claim 1 and further including stand means for supporting said device comprising means for resiliently supporting said second inertial mass member, said first inertial mass member being internally concentric with said second mass member, said elastic member being connected to the first mass member and said second mass member being loosely held against said first mass member.

14. The milling device of claim 13 wherein said means for resiliently supporting said second mass member comprises coil spring means supported on said stand means.

15. The milling device of claim 13 and further comprising ball support means mounted on said stand means, said elastic member comprising an elongated bar supported at its lower end on said ball support means.

* * * * *